US010676301B2

(12) United States Patent
Wallner

(10) Patent No.: US 10,676,301 B2
(45) Date of Patent: Jun. 9, 2020

(54) EXPANDED METAL CORE

(71) Applicant: WALLNER EXPAC, INC., Ontario, CA (US)

(72) Inventor: Michael H. Wallner, Alta Loma, CA (US)

(73) Assignee: WALLNER EXPAC, INC., Ontario, CA (US)

( * ) Notice: Subject to any disclaimer, the term of this patent is extended or adjusted under 35 U.S.C. 154(b) by 0 days.

(21) Appl. No.: 15/886,506

(22) Filed: Feb. 1, 2018

(65) Prior Publication Data

US 2018/0222709 A1 Aug. 9, 2018

Related U.S. Application Data

(60) Provisional application No. 62/454,234, filed on Feb. 3, 2017.

(51) Int. Cl.
*B65H 75/10* (2006.01)
*B65H 18/28* (2006.01)

(52) U.S. Cl.
CPC ..... *B65H 18/28* (2013.01); *B65H 75/10* (2013.01); *B65H 2701/5114* (2013.01); *B65H 2701/5134* (2013.01)

(58) Field of Classification Search
CPC ..... B65H 75/20; B65H 18/25; B65H 75/10; B65H 2701/5114
USPC ..... 242/118.1
See application file for complete search history.

(56) References Cited

U.S. PATENT DOCUMENTS 1,436,866 A 11/1922 Dickinson
1,593,960 A 7/1926 White
1,597,230 A * 8/1926 Hartshorne ..... B65H 75/10 242/118.1
1,837,393 A 12/1931 Arey
2,107,278 A * 2/1938 Baker ..... B21D 31/043 29/6.2
3,042,216 A * 7/1962 Goldman ..... B01D 29/111 210/494.2
3,099,899 A 8/1963 Horn et al.
3,111,204 A 11/1963 Phare
3,813,743 A 6/1974 Harrell et al.
3,890,160 A 6/1975 Daniels, Jr.
4,221,032 A 9/1980 Cousino et al.
4,297,115 A * 10/1981 Johnson, Jr. ..... B01D 46/0043 55/302
4,630,650 A * 12/1986 Davis ..... F16L 11/16 138/129

(Continued)

FOREIGN PATENT DOCUMENTS

DE 102007049116 A1 4/2009
GB 2303646 A 2/1997

OTHER PUBLICATIONS

Anping Fresh Expanded Metal (Expanded Metal Sheeting Technology: Expanded Metal Benefits, Internet Archive, https://web.archive.org/web/20120814150951/https://www.expandedmetalsupplier.com/technology/expanded-metal-benefits.htnnl, Aug. 14, 2012, 3 pages. (Year: 2012).*

(Continued)

*Primary Examiner* — Adam Krupicka

(74) *Attorney, Agent, or Firm* — Lewis Roca Rothgerber Christie LLP

(57) ABSTRACT

A material roll includes a core made from expanded metal, and a first sheet of material wound a plurality of times over the core.

21 Claims, 6 Drawing Sheets

(56) References Cited

U.S. PATENT DOCUMENTS

| | | | | |
|---|---|---|---|---|
| 4,881,307 | A | 11/1989 | Gaissmaier | |
| 5,230,726 | A * | 7/1993 | Smith | B01D 39/2027 210/490 |
| 5,665,131 | A * | 9/1997 | Hock | B01D 39/086 280/740 |
| 5,743,560 | A * | 4/1998 | Jackson | B01D 39/086 280/741 |
| 6,202,271 | B1 | 3/2001 | Goda et al. | |
| 2008/0164369 | A1* | 7/2008 | Adelakun | B65H 75/185 242/579 |
| 2008/0222869 | A1* | 9/2008 | Castricum | B21C 37/121 29/33 D |

OTHER PUBLICATIONS

KATY Plaster Mesh Company, Internet Archive, https://web.archive.org/web/20140729210959/https://plastermesh.com/plastermesh/light-type-expanded-metal.html,Jul. 29, 2014, 2 pages. (Year: 2014).*

DHA Filter, LLC, Meltblown Nanofiber Dust Cartridges, http://www.dhafilter.com/meltblown-nanofiber-dust-cartridges, printed Apr. 2, 2018, 1 page.

* cited by examiner

EXPANDED METAL CORE

CROSS-REFERENCE TO RELATED APPLICATION

This application claims priority to and the benefit of U.S. Provisional Patent Application No. 62/454,234 filed Feb. 3, 2017, the entire content of which is incorporated herein by reference.

BACKGROUND OF THE INVENTION

Cores on which are rolled sheet materials, as for example a metal sheet or an expanded metal sheet are typically formed from cardboard. Cardboard cores are not reusable as they are effected by their surrounding environment. Moisture quickly subjects cardboard cores to water damage. Other environmental factors may also cause a cardboard core to fail or delaminate. Tension applied to the sheet of material when being wrapped on a cardboard core may also subjects a cardboard core to delamination. Thus cardboard cores are made to be disposable and not re-useable. In addition, in order to increase strength, cardboard cores are made thicker (having thicker walls). As a result, they tend to be heavier, have a larger outer diameter and thus allow for less sheet material to be wrapped around them when the outer diameter of the core with the wrapped material has to be limited for shipping and storage purposes.

SUMMARY

In an example embodiment a material roll includes a core made from a sheet of expanded metal, and a sheet of material wound a plurality of times over the core. In one example embodiment, the sheet of expanded metal is a strip of expanded metal. In another example embodiment, the sheet or strip of expanded metal is helically wound to form the core. In yet another example embodiment, the core includes a helically extending seam, the seam being helical about a longitudinal axis of the core. In a further example embodiment, adjacent sides of the sheet (or strip) of expanded metal are connected along a helical path forming the helical seam. In yet a further example embodiment, a first side of the adjacent sides of the sheet or strip of expanded metal is bent onto itself defining a first channel, a second side of the adjacent sides of the sheet or strip of expanded metal is bent onto itself defining a second channel, and end portion of the first side is received in the second channel and an end portion of the second side is received in the first channel. In one example embodiment, the first and second channels are compressed, such that the second channel is compressed on the end portion of the first side and the first channel is compressed on the end portion of the second side defining the seam. In another example embodiment, the core extends axially from a first end to a second end, wherein a first circumferential end is defined on the first end and a second circumferential end is defined on the second end, wherein the first and second circumferential ends are formed by roll forming. In a further example embodiment, the core extends axially from a first end to a second end, and an axial portion of the first end is coated with a coating, and an axial portion of the second end is covered with a coating. In yet a further example embodiment, the core extends axially from a first end to a second end, a first circumferential end is defined on the first end and a second circumferential end is defined on the second end. With this embodiment, the core further includes a first sleeve fitted over the first end and a second sleeve fitted over the second end. In yet another example embodiment, the expanded metal includes a plurality interconnected strands defining a plurality of openings. With this embodiment, each stand bounds two adjacent openings. In a further example embodiment, each opening is diamond shaped. In another example embodiment, the sheet of material is expanded metal.

DESCRIPTION

Figure 1:
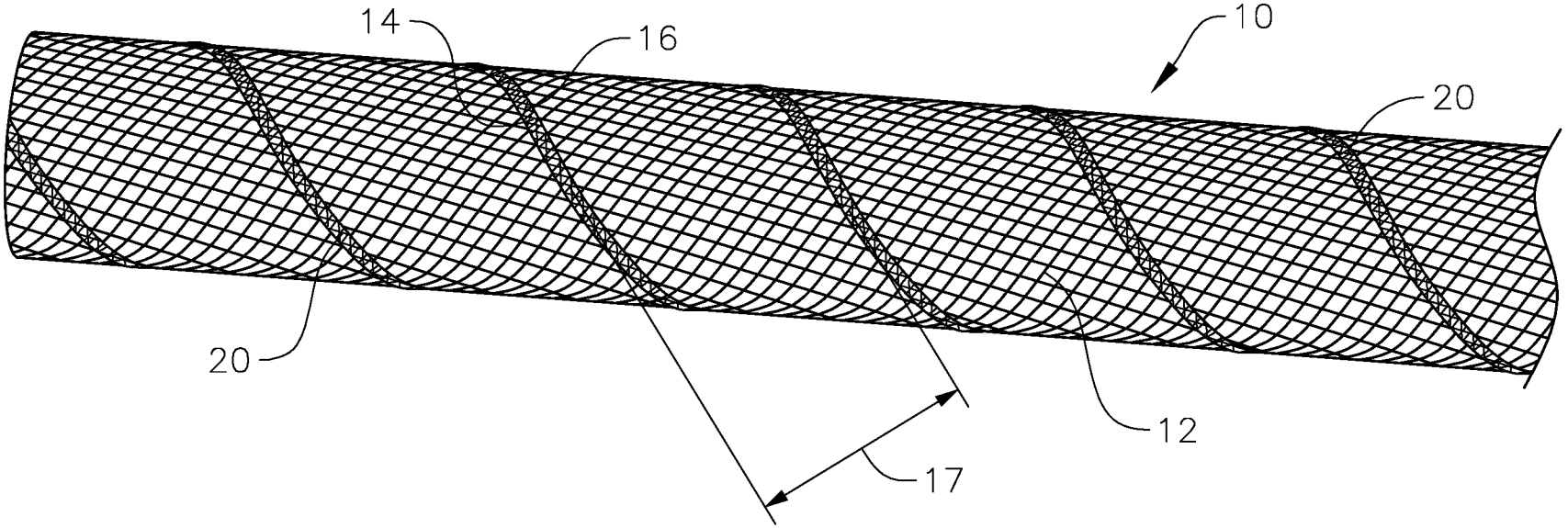
FIG. 1 is a perspective view of an example embodiment expanded metal core.
Figure 2:
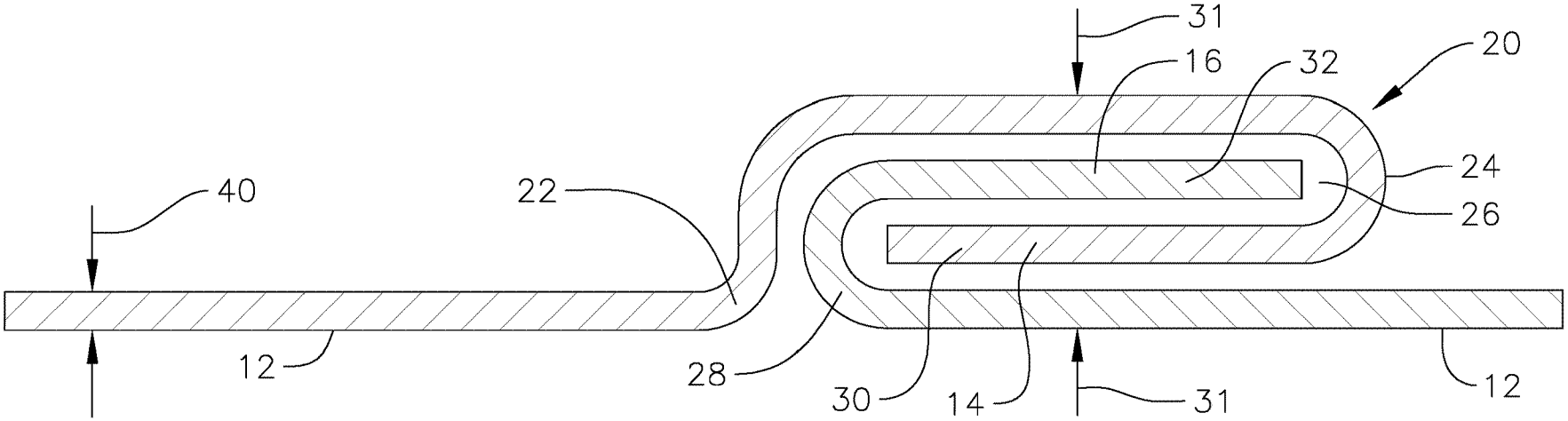
FIG. 2 is a partial enlarged end view showing a seam formed between adjacent sides of an expanded metal sheet forming an example embodiment roll.

In an example embodiment, a core 10 made of expanded metal for rolling sheet material upon it, is disclosed. An example, as such core is shown in FIG. 1. The core is formed by a sheet (e.g., a strip) of expanded metal 12 that is helically wound with adjoining ends 14, 16 as shown in FIGS. 1 and 2. In an example embodiment, the strip of expanded metal 12 has a width 17 of one inch or greater. In an example embodiment, adjacent sides 14, 16 of adjacent of the helically wound expanded metal are folded over and pressed forming a locked seam 20, as shown in FIG. 2. The adjacent side 14 forms a first bend 22, and a second bend 24 in a direction opposite the first bend forming a first channel 26. The other adjacent side 16 is bend forming a second channel 28. An end portion 30 of the adjacent side 14 is received within the second channel 28 while and an end portion 32 of the adjacent side 16 is received in the first channel 26. In an example embodiment, the two channels are collapsed, e.g. compressed, along arrows 31 sandwiching and locking the end portion 30 of the end 14 in the first channel and sandwiching the an locking the end portion 32 of the end 16 in the first channel defining the locked seam. Thus, as can be seen the locked seam 20 extends helically about the length of the core. The locked seam also increases the hoop strength of the core, increasing the core bending strength, as well as increases the core compressive strength along a diameter of the core.

Figure 3:
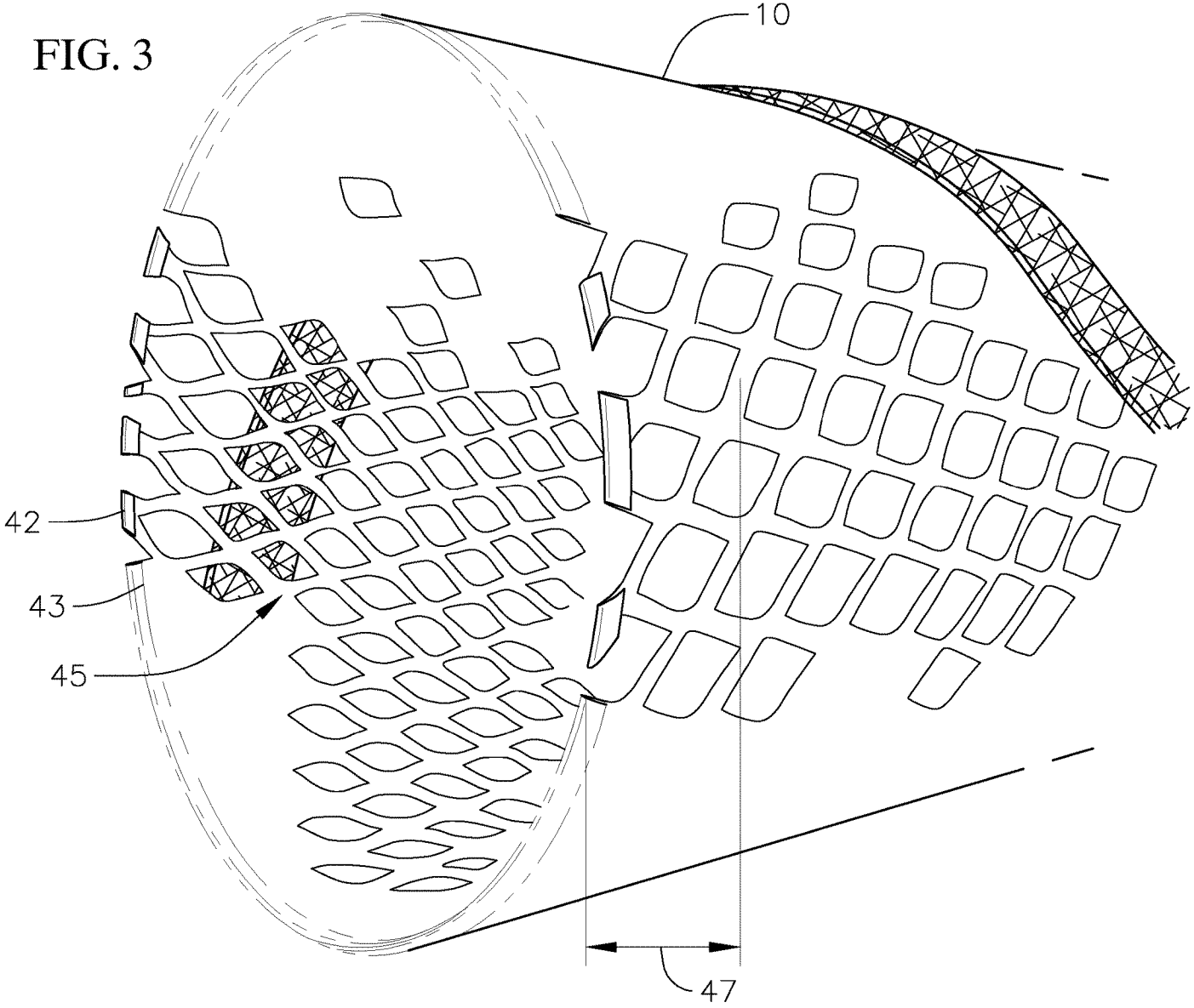
FIG. 3 is a partial perspective end view of an example embodiment expanded metal core.

In an example embodiment, the opposite ends 42 of the expanded metal core 10 are formed by roll forming the edges of the core so that the end 42 are free from jagged edges, as for example shown in FIG. 3. In an example embodiment, the ends are folded over themselves and roll formed as shown in FIG. 3. In an example embodiment, each end 42 is formed by bending an end portion 43 of the expanded metal core inward onto to the inner surface of body 45 of the expanded metal core. The bent end portion may be then roll formed.

In another example embodiment, the ends 42 or end portions 43 of the core may be coated to so as to alleviate the hard edges. The ends may be roll formed or bent onto themselves prior to coating. However, with this embodiment the ends may not have to be roll formed or bent onto themselves and may just be untreated. Example embodiment coatings include industrial epoxies, resins and waxes. An example embodiment coating is Plastidip coating. In an example embodiment, applicants have discovered that a coating thickness of at least 0.012 inch provides sufficient coverage of the untreated and otherwise sharp edges. In an example embodiment, the end portions are coated from the core end to an axial length 47 of a ¼ to 3/16 inch. The coatings may be applied by various methods, such as by dipping the end portions of the core in the coating, or by spraying or painting. In another example embodiment, in lieu of the coating or in addition to the coating, an annular sleeve may be placed over each end 42 or end portion 43 to cover the end. The sleeve may be adhered or crimped onto the end 42 or end portion 43.

Figure 4:
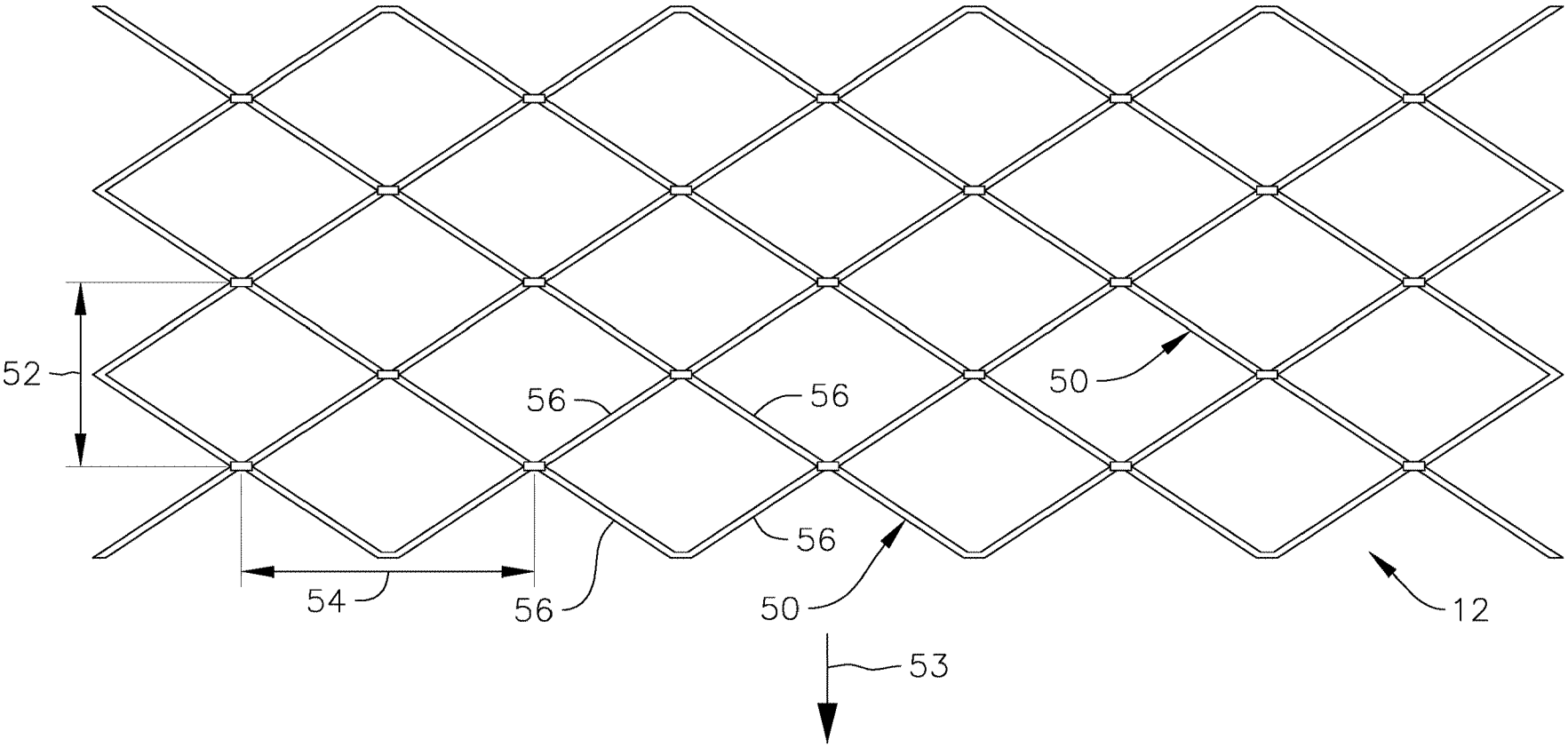
FIG. 4 is a partial front view of a sheet of expanded metal.
Figure 5:
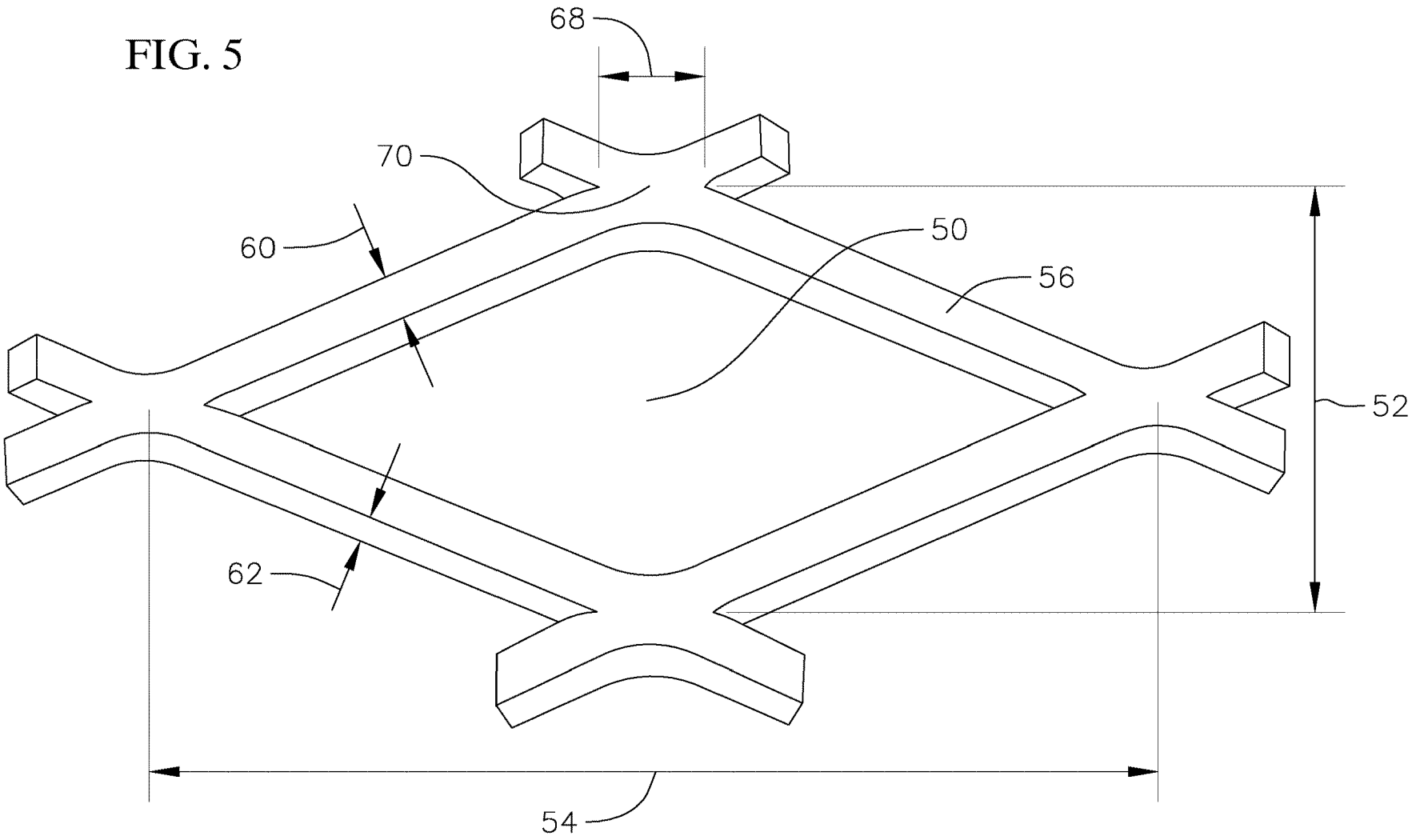
FIG. 5 is a partial perspective view of an expanded metal diamond-shaped opening.
Figure 6:
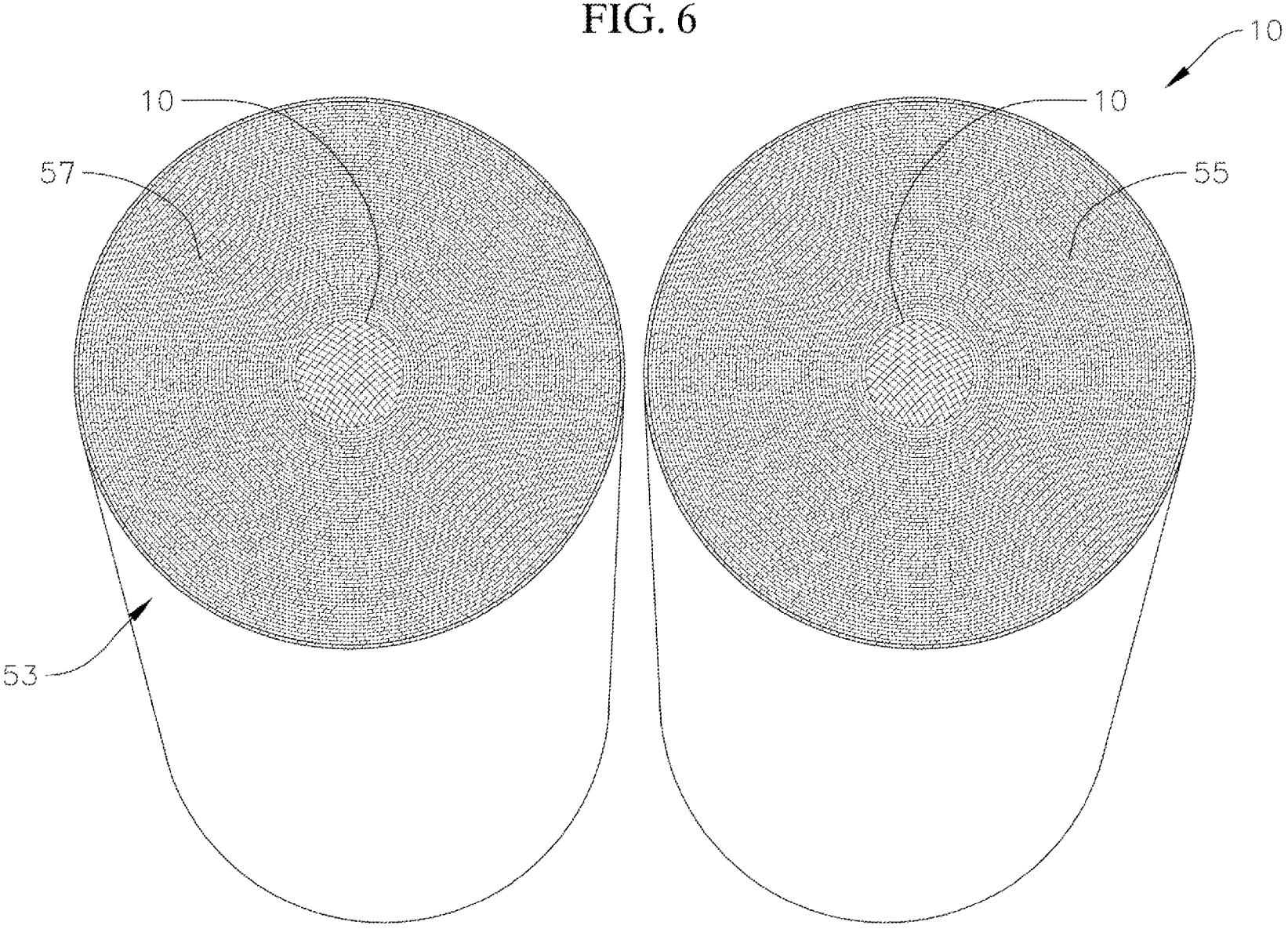
FIG. 6 is a perspective view of two rolls formed by winding a sheet material a plurality times over example embodiment expanded metal cores.

Examples of expanded metal and method of making the same are disclosed in U.S. Pat. No. 8,696,781, the contents of which are fully incorporated herein by reference. Expanded metal in one example embodiment has a plurality of diamond-shaped openings 50 as for example shown in FIGS. 4 and 5. Each diamond-shaped opening has a short way of diamond (SWD) dimension 52 along its direction of expansion 53 and a long way of diamond (LWD) dimension 54 perpendicularly to the SWD dimension. Each diamond-shaped opening 50 is formed with four stands 56. In the example embodiment shown in FIG. 4, each strand forms a boundary for two adjacent diamond-shaped openings 50. An example embodiment expanded metal used to form an example embodiment core has diamond-shaped openings having an LWD dimension in the range of 0.125 to 1 inch and an SWD dimension in the range of 0.06 to 0.5 inch. In an example embodiment, each strand 56 has a thickness 60 in the range of 0.015 to 0.1 inch. In an example embodiment, the expanded metal has a thickness in the range of 0.01 to 0.62 inch. In an example embodiment, the length 68 of a bond 70 is about 10% of the long way of diamond (LWD) dimension, as for example shown in FIG. 5.

A core formed from expanded metal, as shown, is light weight. Because of the locked seams shown in FIG. 2, the core has great strength for resisting bending and collapsing as well as flexing and may be used to roll any type of sheet material even other expanded metal upon it. Because it is made from expanded metal, the core is reusable, it's typically less than half the price of cardboard cores, it's equally as strong as cardboard cores of the same dimensions (e.g., thickness) if not stronger, and it may be more than fifty percent (50%) lighter than cardboard of the same strength and it's also not subject to water damage. It can also accommodate more material as well as heavier material rolled on it.

Example embodiment expanded metal cores may weigh less than cardboard cores having the same wall thickness 40. They also have greater hoop strength than cardboard cores having the same thickness. This allows for a longer amount of sheet material to be wound over the core without the core collapsing. In addition, more tension may be applied to the example embodiment expanded metal core during the winding process without the core collapsing. This allows for tighter wound material over the core.

In an example embodiment, a roll 57 is provided which includes an expanded metal core 10 and a sheet of material 55 wound over the expanded metal core 10 a plurality of times. In the shown example embodiment, the sheet of material is also expanded metal.

While the present disclosure has been described with respect to a limited number of embodiments, those skilled in the art, having benefit of this disclosure, will appreciate that other embodiments and modifications can be devised which do not materially depart from the scope of the invention as disclosed herein. All such embodiments and modifications are intended to be included within the scope of this disclosure as defined in the following claims.

What is claimed is:

1. A material roll comprising:

a core made from expanded metal; and a sheet of material wound a plurality of times over said core, wherein said sheet material is dispensable from said core, wherein said sheet of material is separate from the core prior to being wound over said core, wherein the core extends axially from a first end to a second end, wherein a first circumferential end is defined on the first end and a second circumferential end is defined on the second end, the core further comprising a first covering over said first end and a second covering over said second end.

2. The roll as recited in claim 1, wherein the core is formed by a helically wound sheet of the expanded metal.

3. The roll as recited in claim 2, wherein the core comprises a helically extending seam, said seam being helical about a longitudinal axis of said core.

4. The roll as recited in claim 3, wherein adjacent sides of said sheet of expanded metal are connected along a helical path forming said helical seam.

5. The roll as recited in claim 4, wherein a first side of said adjacent sides is bent onto itself defining a first channel, wherein a second side of said adjacent sides is bent onto itself defining a second channel, wherein an end of said first side is received in the second channel and an end of said second side is received in the first channel defining said helical seam.

6. The roll as recited in claim 5, wherein the first and second channels are compressed, wherein the second channel is compressed on said end of the first side and said first channel is compressed on said end of the second side.

7. The roll as recited in claim 1, wherein said first and second circumferential ends are roll formed.

8. The roll as recited in claim 1, wherein an axial portion of the first end is coated with a coating and wherein an axial portion of the second end is coated with a coating.

9. The roll as recited in claim 1, wherein the expanded metal comprises a plurality interconnected strands defining a plurality of openings, wherein each stand bounds two adjacent openings.

10. The roll as recited in claim 9, wherein each opening is diamond shaped.

11. The roll as recited in claim 1, wherein the sheet of material is a sheet of expanded metal.

12. The roll as recited in claim 1, wherein said roll has an outer diameter that is greater than twice the outer diameter of the core.

13. The roll as recited in claim 1, wherein the first covering is a first sleeve and the second covering is a second sleeve.

14. A material roll comprising:

a core made from expanded metal; and a sheet of material wound a plurality of times over said core, wherein said sheet material is dispensable from said core, wherein said sheet of material is separate from the core prior to being wound over said core, wherein the core extends axially from a first end to a second end, wherein a first circumferential end is defined on the first end and a second circumferential end is defined on the second end, wherein the first circumferential end is defined by bending a portion of said expanded metal onto to itself and wherein the second circumferential end is defined by bending another portion of said expanded metal onto itself.

15. The roll as recited in claim 14, wherein the core is formed by a helically wound sheet of the expanded metal.

16. The roll as recited in claim 14, wherein the sheet of material is a sheet of expanded metal.

17. The roll as recited in claim 14, wherein said roll has an outer diameter that is greater than twice the outer diameter of the core.

18. The roll as recited in claim 14, wherein an axial portion of the first end is coated with a coating and wherein an axial portion of the second end is coated with a coating.

19. A material roll comprising:

a core made from expanded metal; and a sheet of material wound a plurality of times over said core, wherein said sheet material is dispensable from said core, wherein said sheet of material is separate from the core prior to being wound over said core, and wherein the sheet of material is a sheet of expanded metal.

20. The roll as recited in claim 19, wherein the core is formed by a helically wound sheet of the expanded metal.

21. The roll as recited in claim 19, wherein the core extends axially from a first end to a second end, and wherein an axial portion of the first end is coated with a coating and wherein an axial portion of the second end is coated with a coating.

* * * * *